US007731099B2

(12) United States Patent
Keightley

(10) Patent No.: US 7,731,099 B2
(45) Date of Patent: Jun. 8, 2010

(54) STACKED RAILWAY TIE

(75) Inventor: Sean Keightley, Waxahachie, TX (US)

(73) Assignee: Narstco, Inc., Midlothian, TX (US)

( * ) Notice: Subject to any disclaimer, the term of this patent is extended or adjusted under 35 U.S.C. 154(b) by 241 days.

(21) Appl. No.: 11/552,449

(22) Filed: Oct. 24, 2006

(65) Prior Publication Data

US 2007/0108308 A1 May 17, 2007

Related U.S. Application Data

(60) Provisional application No. 60/730,195, filed on Oct. 25, 2005.

(51) Int. Cl.
*E01B 9/14* (2006.01)

(52) U.S. Cl. ..... 238/29; 238/36

(58) Field of Classification Search ..... 238/29, 238/30, 35, 36

See application file for complete search history.

(56) References Cited

U.S. PATENT DOCUMENTS 4,355,754 A * 10/1982 Lund et al. ..... 238/83
4,417,690 A 11/1983 Langman
5,836,512 A 11/1998 Briggs
5,918,806 A 7/1999 Keightley et al.
6,230,981 B1 5/2001 Hill et al.
6,257,494 B1 7/2001 Tokuoka et al.
6,502,760 B2 1/2003 Keedwell
6,604,689 B1 8/2003 Briggs
2005/0156055 A1* 7/2005 Kenney et al. ..... 238/84

* cited by examiner

*Primary Examiner*—S. Joseph Morano
*Assistant Examiner*—Robert J McCarry, Jr.
(74) *Attorney, Agent, or Firm*—Workman Nydegger

(57) ABSTRACT

A railway tie is disclosed having stackable decks for reducing ballast migration in areas where the crib is reduced or removed in order to accommodate additional railway equipment. The stackable railway tie can include a base deck, a top deck, and a fastening system for securing the top deck to the base deck. A second fastening system may be integrated in the railway tie for securing one or more rails to the top deck. The top deck can be configured to transmit a load, such as that from the weight of a train, to the base deck. A ballast displacement system can be provided to distribute a load on the base deck to ballast under the railway tie. One or more top decks may be used in connection with electrically insulating the rails. Nonconductive deck spacers and side posts may insulate the top deck from the bottom deck. Side posts may electrically insulate the base deck from the fastener system.

34 Claims, 4 Drawing Sheets

STACKED RAILWAY TIE

CROSS-REFERENCE TO RELATED APPLICATIONS

This application claims benefits from U.S. Provisional Patent Application, Ser. No. 60/730,195, filed on Oct. 25, 2005, entitled "STACKED RAILWAY TIE", the disclosure of which is hereby incorporated by reference.

BACKGROUND OF THE INVENTION

1. The Field of the Invention

Exemplary embodiments of the invention relate to transportation. More particularly, exemplary embodiments relate to transportation by rail. More particularly still, exemplary embodiments of the invention relate to stacked railway ties.

2. The Relevant Technology

Railway systems play an important role in North American and other worldwide economies. Railway systems can be adapted to run over land or water and thus provide a quick, reliable, convenient, and generally inexpensive method of transportation for both products and people.

Railway systems run over sets of tracks, and each track is made up of one or more rails. A railway tie is a well-known apparatus for use in supporting a rail. In practice, multiple ties are spaced to support sections of the rail so as to form the track over which a train may run. Railway ties may be made of a variety of materials including timber, reinforced concrete, composites, such as plastic composites or carbon, or steel. A railway tie may comprises a solid block which has upper and lower surfaces for contacting a rail and ballast, respectively. In operation, the railway tie is either placed on the ballast or partially submerged within the ballast, and the rail is secured to the upper surface of the railway tie. For example, when the railway tie is comprised of timber or plastic composite, the rail is secured to the railway tie via a tie plate.

As a train moves along a rail and across the railway ties, the tie supports the weight of the train and helps to transfer at least a portion of the load to ballast. Train movement also creates frictional forces and vibrations which may cause the railway ties to shift position or which may cause ballast to migrate and thereby cause cavities or otherwise reduce the ballast in contact with the railway tie. If the ballast migration is left uncorrected, the railway tie may be unable to effectively transfer load to the ballast and may fail. Alternatively, the shift in the ballast may cause the railway tie and the rail to fall out of alignment. Failure or misalignment of a railway tie can cause misalignment of the track, which can ultimately result in train derailment. To reduce ballast migration, and ultimately to prevent derailment, the crib (the void between adjacent ties) can be filled with additional ballast. To the extent the additional ballast does not effectively prevent ballast migration, expensive processes may be necessary to refill cavities, or alternatively, removal and/or replacement of the ties may be required.

Commonly, equipment such as switch rods, electric wire conduits, or other track components are placed or run between ties. When this equipment is in place between the ties, the crib is reduced. With the crib reduction there is less ballast filled in between railway ties, and greater ballast migration may result under the ties. One approach to resolve this is to allow for greater clearance for the equipment by raising the railway tie, and thereby reducing or eliminating the partial submersion within the ballast. While reducing the submersion of the railway tie allows for greater clearance and more ballast to fill the crib, the contact with ballast below the tie is reduced, which increases the tendency for cavities to form. Reducing the submersion of the tie also reduces the railway tie's resistance to lateral and longitudinal movement or displacement.

Railway ties have a limited service life before replacement becomes necessary. When the rail is connected to the railway tie, the weight of the rail and passing trains stresses the tie, with the stress being most concentrated near the areas where the rail contacts the tie and where the tie contacts ballast. Additional stress is placed on the tie from the removal and/or replacement of rails. Over time, the continual and cyclical loads on the stressed railway tie may cause the tie to fail, so as to require replacement. Additionally, train derailment may uproot a railway tie or may sufficiently damage a tie so as to necessitate replacement. When the service life ends and replacement is necessary, the tie is completely removed and a new tie is placed in or on the ballast. Often, where ballast migration occurred, replacement may be time consuming and/or expensive because ballast may need to be refilled and repacked before the new tie can be positioned.

Railway ties made of timber and steel have been used for more than a hundred years, and railway ties made with reinforced concrete have been used for the last thirty years. Traditionally, steel ties were more expensive than concrete or timber ties, but had a longer service life. Due in part to converging prices of steel and timber, the popularity of steel ties is increasing even where a timber tie has been treated with creosote to improve its service life. In part, this increased popularity is the result of other cost savings that can be realized by using steel ties. For example, steel ties are lighter than the timber or concrete counterparts so transportation costs are reduced. Because of the reduced weight, the dead loads that must be supported by bridges and foundations for railway tracks are also reduced. Additionally, steel ties wear better than timber ties in humid, wet environments, are not affected by insect infestation, do not suffer from plate cutting or spike kill, require less ballast per mile, allow greater load spreading capabilities, can be spaced at greater distances, are recyclable, require less material handling, and have better derailment survivability than either timber or concrete ties.

Despite the advantages that steel offers, timber ties are the traditional choice for most railroad applications, and are often used where the track carries electrical circuits for electrical signal systems or to reduce vertical pullout. Approximately twenty percent of the track mileage in North America has track signal systems using track circuits. A track circuit uses the rails as the conductors and the train wheels and axles as the switch for activating signals. Unlike timber ties, steel ties can conduct electricity. Thus, timber ties are more commonly used on tracks employing track circuits because steel ties can complete the track circuit and disrupt the signaling systems. Where track signal systems are necessary in conjunction with conductive ties, such as steel ties, insulator systems are required to reduce or prevent short-circuit of the electrical current through the conductive tie material. All concrete ties require rail seat insulation systems to protect the concrete from damage that would be imparted by direct contact with the steel rail regardless of track signal requirements.

BRIEF SUMMARY OF THE INVENTION

Embodiments of the present invention relate to a stacked railway tie that supports the weight of a train by transmitting the load to ballast. A stacked railway tie can allow for improved track surface and alignment, while also providing greater clearance for railway equipment. A stacked railway tie can further allow the tie to be positioned deeper into the ballast, thus reducing ballast migration and improving the service life of the tie. The present invention can be helpful in railway environments where ballast migration may occur and where vertical, lateral and longitudinal forces may displace the tie and cause track misalignment. Additionally, the present invention may reduce ballast migration in areas where the crib is reduced or removed in order to accommodate railway equipment.

In one exemplary embodiment of the invention, a stacked railway tie includes a base deck, a top deck stacked on and coupled to the base deck by a fastening system, and a deck spacer positioned between the top and base decks. The stacking of the top deck on the base deck can allow the base deck to be positioned deeper into the ballast underneath the top deck such that ballast migration is reduced. This can be particularly useful in settings where the crib or the ballast positioned between ties is reduced or eliminated in order to accommodate other railway equipment, or in other applications where ballast is reduced.

The base deck may be configured to be positioned within and/or on top of ballast. The top deck may be configured to have at least one rail mounted thereon to in turn couple the rail to the base deck. Such a configuration of the stacked railway tie may facilitate transmission of the load force ultimately to the ballast positioned beneath the base deck. The stacking of decks may allow the base deck to be positioned deeper within the ballast yet still maintain the height of the rail to an adequate level such that elevation requirements are met. The stacked railway tie may further include a fastening system configured to couple the top deck to the base deck. In one embodiment, the fastening system includes one or more clamps. In other embodiments, the fastening system includes one or more bolts. In some embodiments, the stacked railway tie further includes a second fastening system that can be configured to couple at least one rail to the top deck.

The stacked railway tie may further include a deck spacer positioned between the top and base decks in order to offset the top deck from the base deck. The deck spacer can be configured to facilitate transmission of the load force induced on the top deck to the base deck and thus the ballast positioned beneath the base deck, and to support the load force placed thereon from an over-passing train. Additionally, the deck spacer may be used to adjust the height of the top deck, thus facilitating correct alignment of a rail.

In some embodiments, the stacked railway tie may further include a ballast displacement system to distribute a load on the tie to ballast. The ballast displacement system may connect to the underside of the base deck, and can increase the surface area of the stacked railway tie that is in contact with ballast. The ballast displacement system may include a single block or multiple blocks which can distribute the load from the base deck to ballast.

In an alternative embodiment, a stacked railway tie includes a base deck, a top deck stacked on the base deck and electrically insulated from the base deck. Electrical isolation between the base deck and the top deck may be enabled by employing nonconductive side plates, deck spacers, and/or side posts. The side plates and deck spacers can maintain a separation between the base deck and the top deck, thus preventing conduction. Side posts isolate the top deck from the fasteners, and may also include ramps to allow proper positioning of the fasteners.

In an alternative embodiment, a stacked railway tie may include a base deck, a first top deck stacked on the base deck, and a second top deck stacked on the first top deck and electrically insulated from the first top deck. Electrical isolation between the first top deck and the second top deck may be enabled by employing nonconductive side plates, deck spacers, and/or side posts. The side plates and deck spacers can maintain a separation between the first top deck and the base deck, thus preventing conduction. Side posts isolate the first top deck from the fasteners, and may also include ramps to allow proper positioning of the fasteners.

In one embodiment, a method for making a stacked railway includes providing a base deck, placing a spacer on the base deck, stacking the top deck on the base deck such that the spacer can be positioned between the base deck and the top deck, securing the top deck to the base deck, and securing a rail to the top deck. In some embodiments, securing the top deck to the base deck or rail may be done with a clamp or bolt. In other embodiments, the method for making a stacked railway tie further includes the step of insulating the top deck from a second top deck.

In another embodiment, a method for distributing a load between a stacked railroad tie and ballast includes providing a base deck and configuring that deck to receive a top deck, coupling the top deck to the base deck, configuring the top deck to distribute a load to the base deck, placing a ballast displacement system in communication with the base deck, and adapting the ballast displacement system to distribute a load on the base deck to ballast. Distribution of the load from the top deck to the base deck may include positioning a spacer between the top and base decks.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that not all of these and other contemplated advantages are required in all embodiments of the invention. It is further appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention is directed to a stacked railway tie having multiple decks through which the weight of a train can be transmitted to ballast. A feature of one exemplary embodiment can be at least one top deck that can increase clearance for railway equipment, and which can be removable to enable quick and effective replacement or repositioning of the deck and rails. The top deck may be selectively fastened to other components of the tie. The present invention can be helpful in railway environments where rails need to accommodate railway equipment in the crib, where adjustments are necessary to improve track alignment, or where replacement of the removable deck is necessary. The stacked railway tie of the present invention can further act to reduce ballast migration in areas where the crib is reduced or eliminated in order to accommodate railway equipment.

Figure 1A:
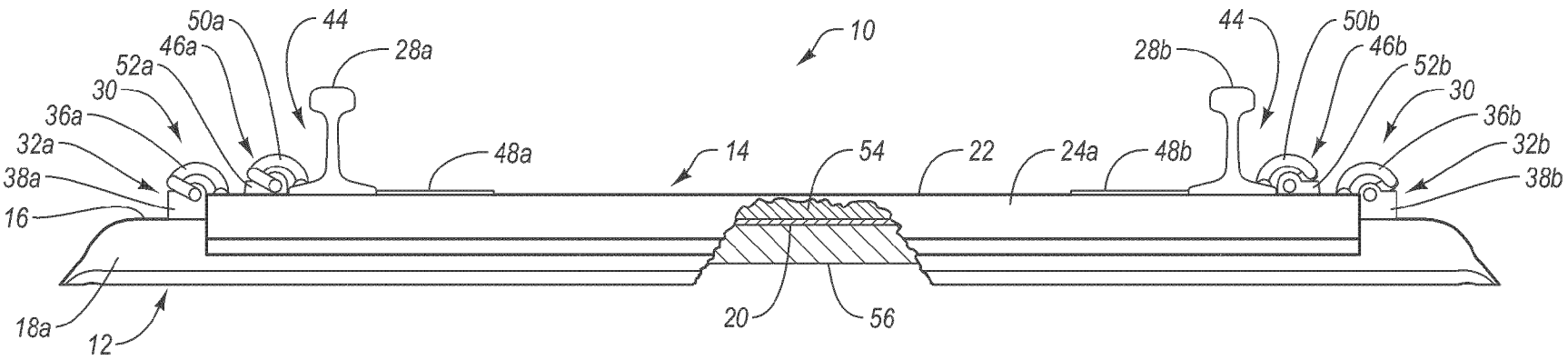
FIG. 1*a* is a frontal view of a stacked railway tie illustrating a top deck stacked on a base deck wherein a single track is coupled to the top deck.
Figure 1B:
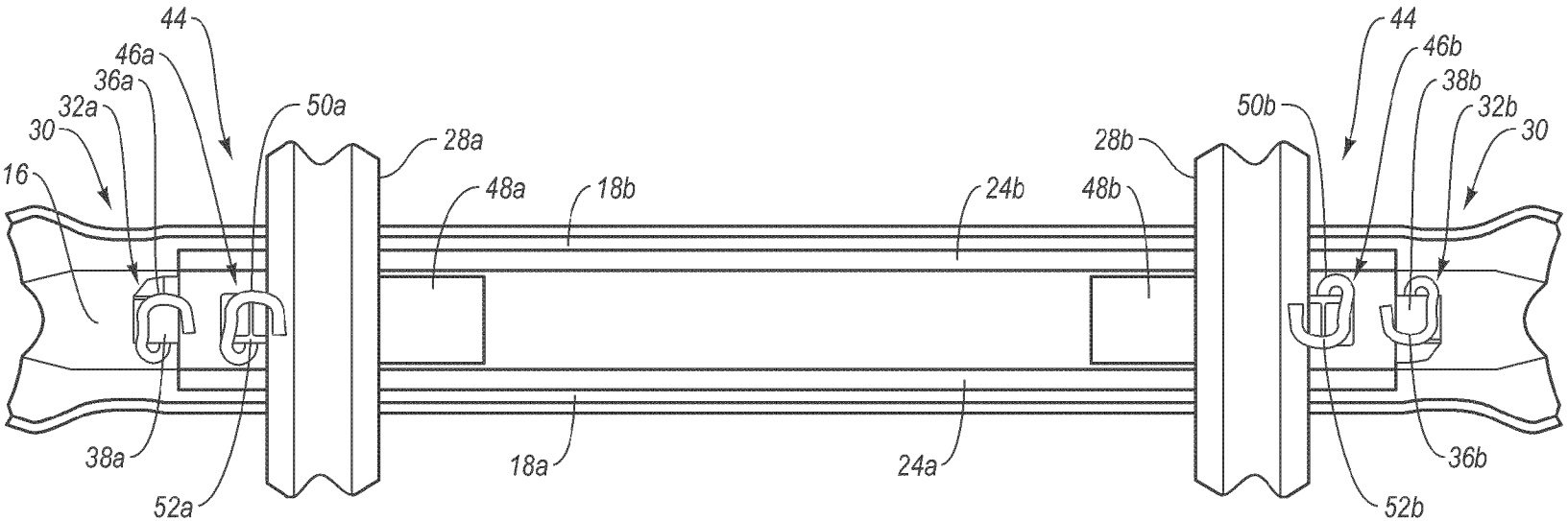
FIG. 1*b* is a top view illustrating the stacked railway tie of FIG. 1*a;*

FIGS. 1*a* and 1*b* illustrate an exemplary embodiment of a stacked railway tie 10. According to one embodiment of the present invention, stacked railway tie 10 can be configured to reduce ballast migration in areas where the crib is reduced or removed in order to accommodate additional railway equipment such as switch rods, electric wire conduits, or other track components. In the illustrated embodiment, stacked railway tie 10 includes a base deck 12 and a top deck 14 stacked on top of and coupled to base deck 12. Stacking of decks in this manner may provide many advantages. For instance, the additional weight introduced into stacked railway tie 10 from top deck 14 can increase the deadweight of the tie. Increasing the tie's deadweight can improve the vertical pullout. Additionally, the stacking of top deck 14 and base deck 12 can improve switch rod clearance, and drainage and deicing from around the track. Further, stacked railway tie 10 can reduce the stress on the base deck when rails or tracks are removed and/or replaced. Also, in the event of a train derailment, stacked railway tie 10 can be less expensive to fix due to the need to replace only the top deck.

Base deck 12 may be configured to transmit the weight of an over-passing train and any equipment attached to the stacked railway tie 10 to the ballast positioned beneath base deck 12. Base deck 12 may further be configured to have another deck stacked thereon, such as top deck 14. In the illustrated embodiment, base deck 12 includes a mounting surface 16, sides 18*a, b*, and an underside 20. In one embodiment, mounting surface 16 can be substantially flat such that fasteners, spacers, equipment, or track components can easily be mounted thereon and coupled thereto. Underside 20 of base deck 12 may also be substantially flat and configured to have equipment mounted thereon. Base deck 12 can be made from a single piece of steel. However, in alternative embodiments, base deck 12 can be made of composite material, other metals, or any other material sufficient to withstand the forces induced thereon by a train and any equipment attached or mounted to base deck 12. Further, in alternative embodiments, base deck 12 may include multiple pieces of material such as, for example, separately formed sides 18*a, b*. In one embodiment, base deck 12 is a steel tie.

Top deck 14 may also be configured to transmit the weight of a train and any equipment, rails, or components attached or mounted to top deck 14 to base deck 12. Top deck 14 may further be configured to have another deck stacked thereon. In addition, top deck 14 can be configured to have at least one rail coupled to top deck 14. In the illustrated embodiment, top deck 14 includes a mounting surface 22, sides 24*a, b*, and an underside 26. Mounting surface 22 may be substantially flat and/or configured to have equipment and at least one rail mounted thereon and coupled thereto. In the illustrated embodiment, top deck 14 has mounted thereon rails 28*a, b*. Top deck 14 can be made from a solid piece of steel. However, in alternate embodiments, top deck 14 can be made of a composite material, a metal, or any other material sufficient to withstand the normal forces induced in a railway tie. In still other embodiments, top deck may include multiple pieces including, for example, separately formed sides 24*a, b*, or multiple pieces forming mounting surface 22. In one embodiment, top deck 14 is a steel tie.

In the illustrated embodiment, top deck 14 is stacked on base deck 12 and can be coupled thereto by first fastening system 30. The coupling of top deck 14 to base deck 12 can facilitate coupling of rails 28*a, b* to base deck 12. First fastening system 30 may be configured to couple top deck 14 to base deck 12. In one embodiment, first fastening system 30 includes first fastener 32*a* and second fastener 32*b*. Using first fastener 32*a* and second fastener 32*b* in tandem may present many advantages. For example, where the sides of top deck 14 are prone to lateral, longitudinal, or vertical displacement, first fastener 32*a* and second fastener 32*b* can each limit the displacement of one end, thus limiting the displacement of top deck 14 as a whole.

First fastener 32*a* may further be configured to reduce the lateral, longitudinal, and vertical movement and displacement of top deck 14. In one embodiment, first fastener 32*a* is coupled to mounting surface 16 of base deck 12 and secured to mounting surface 22 of top deck 14 so as to reduce vertical and lateral movement of top deck 14. First fastener 32*a* may be mounted to mounting surface 16 of base deck 12 and secured to mounting surface 22 of top deck 14 with any conventional method including, for example, welds, hooks, lynch pins, brackets, or bolts. In the illustrated embodiment, first fastener 32*a* abuts a terminating edge of top deck 14 so as to reduce longitudinal movement or displacement of top deck 14.

First fastener 32*a* may also be configured to be selectively releasable, such that top deck 14 can be removable. In the illustrated embodiment, first fastener 32*a* includes a clip 36*a* and a shoulder clamp 38*a* combination. Clip 36*a* may be positioned over top deck 14. In the illustrated embodiment, clip 36*a* is in communication with top deck 14 and can apply a force which limits the vertical and lateral movement by top deck 14. To remove top deck 14, clip 36*a* can be lifted and taken out of communication with top deck 14. It should be appreciated by a person of ordinary skill in the art in view of the disclosure provided herein that the illustrated first fastener 32*a* is exemplary only and that alternative embodiments are within the scope of this invention. For example, first fastener may permanently couple top deck 14 to base deck 12 through a weld, rivet, or the like. Alternatively, other selectively releasable fasteners such as, for example, bolts or C-clamps are contemplated.

In one embodiment, second fastener 32*b* is configured in substantially the same way as first fastener 32*a*, and/or can be identical to first fastener 32*a*. Second fastener 32*b* may be coupled to mounting surface 16 of base deck 12 and secured to mounting surface 22 of top deck 14 so as to reduce vertical and lateral displacement of top deck 14. In one embodiment, second fastener 32*b* abuts a terminal edge of top deck 14 so as to reduce longitudinal movement and displacement of top deck 14. In the illustrated embodiment, second fastener 32*b* includes a clip 36*b* and a shoulder clamp 38*b* combination. It is appreciated that it is not necessary that second fastener 32*b* and first fastener 32*a* be identical, or that first fastening system 30 have a first fastener 32*a* and a second fastener 32*b*. For example, first fastening system 30 may be configured to reduce the lateral, longitudinal and vertical movement or displacement of top deck 14 with any number of fasteners, including a single fastener or more than two fasteners.

In another embodiment, stacked railway tie 10 may further be configured to have rails 28*a, b* mounted and fastened thereon. Stacked railway tie 10 may also include a second fastening system 44 configured to couple rails 28*a, b* to top deck 14. Coupling of rails 28*a, b* to top deck 14, in combination with first fastening system 30 coupling top deck 14 to base deck 12, links and couples rails 28*a, b* ultimately to base deck 12. In the illustrated embodiment, second fastening system 44 includes a first fastener 46*a* and a retention plate 48*a*. First fastener may be configured to reduce lateral, longitudinal and vertical displacement of rail 28*a*. In one embodiment, first fastener 46*a* is coupled to mounting surface 22 of top deck 14. In some embodiments, first fastener 46*a* can abut an edge of the base of rail 28*a* and can be secured against the base of rail 28*a* so as to reduce vertical, lateral and longitudinal displacement of rail 28*a*. In the illustrated embodiment, first fastener 46*a* includes a clip 50*a* and a shoulder clamp 52*a* combination. Clips 50*a, b*, as well as clips 36*a, b*, can be resilient and made of steel. However, as will be appreciated by one of ordinary skill in the art in view of the disclosure provided herein, clips 36*a, b* and 50*a, b* may embody a variety of other characteristics and need not be resilient, and may also be made of different metals or composite materials.

In still other embodiments, retention plate 48*a* may be configured to reduce lateral movement of rail 28*a*. In one embodiment, retention plate 48*a* includes a substantially flat piece of metal such as steel, and can be mounted on mounting surface 22 of top deck 14. The coupling of first fastener 46*a*, and the mounting of retention plate 48*a* to mounting surface 22 of top deck 14, may be done by any conventional means including, for example, welds, rivets, or bolts. Retention plate 48*a* may further be configured to substantially prevent lateral movement of rail 28*a* when rail 28*a* is mounted on top deck 14 and first fastener 46*a* is coupled to top deck 14 and secured against the base of rail 28*a*.

In one embodiment, retention plate 48*a* is positioned on top deck 14 a distance away from first fastener 46*a* that is sufficient to allow the base of rail 28*a* to be positioned there between. The distance between first fastener 46*a* and retention plate 48*a* should not be so great so as to allow gaps to form between rail 28*a* and either first fastener 46*a* or retention plate 48*a*. In the illustrated embodiment, the combination of first fastener 46*a* and retention plate 48*a* can substantially minimize gaps around the bottom of rail 28*a*, and can reduce the lateral movement of rail 28*a*.

Rail 28*b* may be coupled to top deck 14 in substantially the same way as rail 28*a*. In one embodiment, rail 28*b* is coupled to top deck 14 by second fastener 46*b* and retention plate 48*b*. In the illustrated embodiment, first fastener 46*a* can be identical to first fastener 46*b* and retention plate 48*a* can be identical to retention plate 48*b*. However, it is not necessary that first fastener 46*a* be identical to second fastener 46*b*, nor that retention plate 48*a* be identical to retention plate 48*b*. As will be appreciated by one of ordinary skill in the art in view of the disclosure provided herein, a variety of types and configurations may be utilized as first fastener system 30 or second fastener system 44 without departing from the spirit and scope of the invention. For example, clamps, welds, tie fasteners, bolts, rivets, brackets, braces, and end fasteners are all within the scope of the present invention.

FIG. 1*a* further illustrates the use of a deck spacer 54 and a ballast displacement system 56 utilized in connection with stacked railway tie 10. In one embodiment, deck spacer is positioned between base deck 12 and top deck 14. Ballast displacement system 56 may be located below base deck 12 such that it is positioned to be in contact with the ballast.

Figure 2:
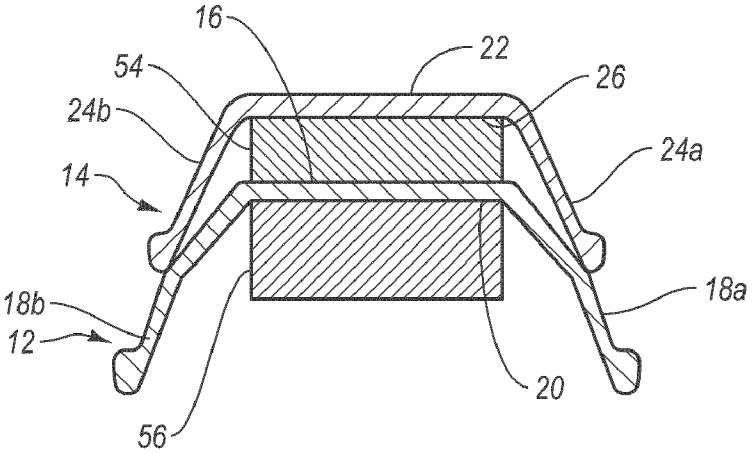
FIG. 2 is a cross-sectional view of the stacked railway tie of FIG. 1 and illustrates a deck spacer and a ballast displacement system.

FIG. 2 is a cross-sectional view illustrating deck spacer 54 and ballast displacement system 56 in relation to top deck 14 and base deck 12. Deck spacer 54 may be configured to separate top deck 14 from base deck 12. In the illustrated embodiment, deck spacer 54 is positioned between top deck 14 and base deck 12. Deck spacer 54 may be set or mounted on mounting surface 16 of base deck 12 and held in place through first fastening system 30. In one embodiment, deck spacer 54 contacts underside 26 of top deck 14, and thus at least partially offsets top deck 14 from base deck 12 by separating underside 26 of top deck 14 from mounting surface 16 of base deck 12.

Deck spacer 54 may further be configured to support top deck 14 and to distribute loads to base deck 12. In the illustrated embodiment, deck spacer 54 includes a block of material having a length substantially equal to or larger than the length of top deck 14. Deck spacer 54 may also have a predetermined thickness according to the desired separation of top deck 14 from base deck 12. Deck spacer 54 can be made of different types of material such as a metal, polymer, or a composite, or from a variety of other materials that are sufficient to substantially support top deck 14 and distribute loads through to base deck 12 without failure. Deck spacer 54 can be a single piece of material or multiple pieces of material, and may be solid or hollow. In one embodiment, the construction shape and type of material can be such that deck spacer 54 substantially supports top deck 14 and substantially distributes load to base deck 12. Deck spacer 54 can be made from mild steel, High Density Polyethylene ("HDPE"), Ultra High Molecular Weight Polyethylene ("UHMW"), or polyurethane.

Deck spacer 54 may further be configured to improve track surface and alignment, and to improve clearance for switch rods, electric wire conduits, or other track components, while not requiring replacement or adjustment of base deck 12. One feature of embodiments utilizing deck spacer 54 in relation to stack railway tie 10 is that deck spacer 54 can provide adjustability as to the height of top deck 14 in relation to base deck 12 and in relation to the ballast positioned beneath base deck 12. Deck spacer 54 may be replaced, or the width of deck spacer 54 may be modified. Consequently, the base deck 12 can remain deep into ballast while a change in deck spacer 54 can alter the height of top deck 14. This feature can be particularly useful where crib is reduced for clearance, as base deck 12 can remain deep in the ballast, while the height of top deck 14 is increased. Further, deck spacer 54, when made from a nonconductive material, provides for a nonconductive layer between top deck 14 and base deck 12, which may facilitate the use of steel railway ties even where the track carries electrical circuit systems.

Deck spacer 54 may also be configured to extend the service life of stacked railway tie 10. In one embodiment, deck spacer 54 can operate in connection with ballast displacement system 56 to facilitate the distribution of loads to the ballast positioned beneath base deck 12, thus reducing the stress on stacked railway tie 10 and prolong the service life of top deck 14, base deck 12, and stacked railway tie 10. Additionally, top deck 14 may be stacked on base deck such that sides 24*a, b* are in communication with sides 18*a, b* of base deck 12. While it is not necessary for sides 24*a, b* of top deck 14 to be in contact with sides 18*a, b* of base deck 12, such a configuration, in combination with deck spacer 54, can provide for a more stable and rigid stacked railway tie 10, thus also contributing to an extended service life of stacked railway tie 10.

FIG. 2 further illustrates ballast displacement system 56. In some embodiments, ballast displacement system 56 can be secured to and in communication with underside 20 of base deck 12. Ballast displacement system 56 may be configured to support base deck 12 and distribute loads to the ballast positioned beneath base deck 12. In the illustrated embodiment, ballast displacement system 56 includes a block of material extending substantially the length of base deck 12.

As will be appreciated by one of ordinary skill in the art in view of the disclosure provided herein, ballast displacement system 56 is not limited to a solid block of material. In other embodiments, ballast displacement system 56 may include, for example, a hollow block or multiple blocks spaced along the length of base deck 12. In still other embodiments, ballast displacement system 56 may include plating. Ballast displacement system 56 may be comprised of a material that is a metal, a composite, or some other material. A suitable material for ballast displacement system 56 can be capable of supporting base deck 12 and distributing loads to the ballast without failure. Ballast displacement system 56 can include steel and/or HDPE composite.

In one embodiment, ballast displacement system 56 is coupled to underside 20 of base deck 12 via welding or through brackets and screws. Utilizing ballast displacement system 56 in conjunction with stacked railway tie 10 can provide many advantages. For example, ballast displacement system 56 may reduce the void space beneath base deck 12 such that more surface area of stacked railway tie 10 and base deck 12 are in contact with the ballast positioned beneath base deck 12. The reduction of void space beneath base deck 12 can provide increased support for base deck 12, provide for the longer service life of stacked railway tie 10 due to reduction of stress on base deck 12, and provide for a more solid base for the track coupled to stacked railway tie 10, thus improving the track surface and alignment.

Figure 3:
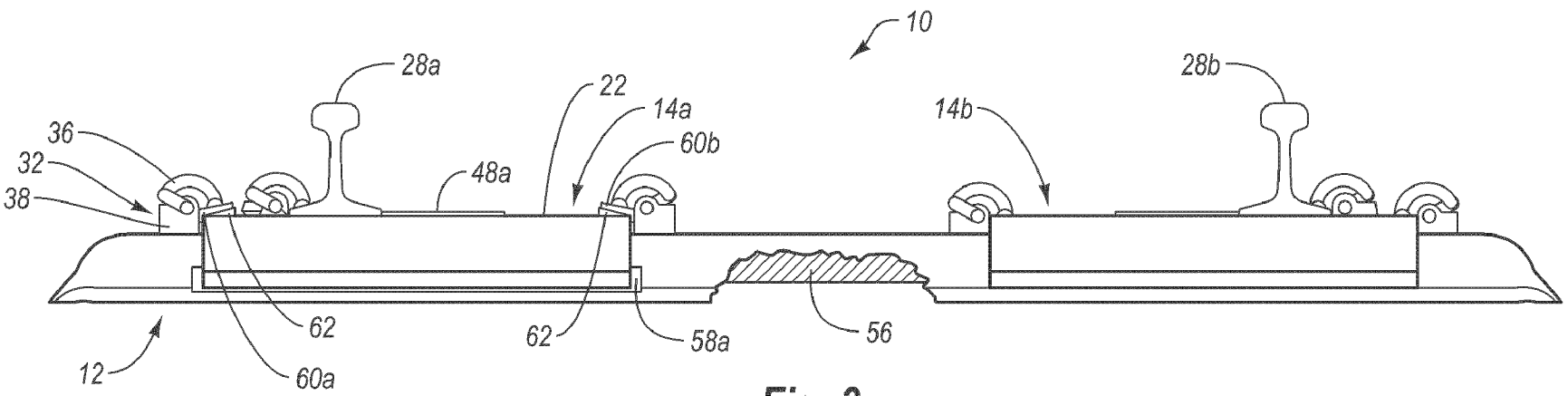
FIG. 3 is a frontal view illustrating a stacked railway tie having two top decks stacked on a base deck, wherein each rail of a track is coupled to a separate top deck.

FIG. 3 is a frontal view illustrating an alternative embodiment of stacked railway tie 10, wherein rail 28*a* can be electrically insulated from rail 28*b*. In an exemplary embodiment, stacked railway tie 10 includes base deck 12, a first top deck 14*a* stacked on base deck 12, and a second top deck 14*b* stacked on base deck 12, wherein first base top deck 14*a* is electrically insulated from second top deck 14*b*. A stacked railway tie 10 that electrically insulates rail 28*a* from rail 28*b* can provide many advantages. For example, in environments where it is required to electrically insulate between rails of multiple tracks, stacked railway tie 10 may be utilized. Such environments include, for example, rail switching systems and/or train location indicator systems utilizing the current induced in a rail.

In the illustrated embodiment, stacked railway tie is configured to electrically insulate first top deck 14*a* from second top deck 14*b* by using side plates 58, side post insulators 60, and a nonconductive deck spacer 54. When stacked railway tie 10 supports two rails 28*a, b*, the illustrated embodiment further demonstrates that to electrically insulate rail 28*a* from rail 28*b*, it may not be necessary to utilize nonconductive side plates 58*a, b* nor side post insulators 60*a, b* in connection with top deck 14*b*. However, as will be appreciated by those of skill in the art, rails 28*a, b* could easily be electrically insulated from base deck 12 by utilizing nonconductive side plates, side post insulators, and nonconductive deck spacers similar to those utilized with top deck 14*a*.

Side plate 58*a* may be positioned between the sides of top deck 14*a* and base deck 12, such that side plate 58*a* separates top deck 14*a* from base deck 12. Side plate 58*b* may also be oriented in a similar manner as side plate 58*a*. However, side plate 58*b* may separate the opposing sides of top deck 14*a* and base deck 12. In the illustrated embodiment, side plates 58*a, b* include a flat, nonconductive and resilient plate extending at least the length of top deck 14*a*. In other embodiments, side plates 58*a, b* may be shorter than top deck 14*a* so long as the length is sufficient to maintain the separation of top deck 14*a* from base deck 12. Side plates 58*a, b* can be made from HDPE, UHMW or polyurethane. Alternatively, side plates 58*a, b* may include a metal and a nonconductive composite combined in such a way that the overall side plate is nonconductive. In still other embodiments, other nonconductive materials can be used and have sufficient mechanical properties to withstand the forces exerted on it by top deck 14*a* and base deck 12. Side plates 58*a, b* may also have a predetermined width and thickness that is sufficient to separate the sides of base deck 12 and top deck 14*a*. The shape of side plates 58*a, b*, can determine separation of sides 18*a, b* of base deck 12 from sides 24*a, b* of top deck 14 and, in conjunction with them being made of a nonconductive material, may facilitate electric insulation of rail 28*a* from rail 28*b*.

In some embodiments, side post insulators 60*a, b* can be configured to facilitate electric insulation of rail 28*a* from rail 28*b*. In the illustrated embodiment, side post insulator 60*a* can be identical to side post insulator 60*b*. As such, description will now be given with reference to only side post insulator 60*a*. However, it is not required that side post insulator 60*b* be identical to side post insulator 60*a*. In one embodiments, side post insulator 60*a* includes a piece of resilient nonconductive material for facilitating electrical insulation between top deck 14*a* and fastener 32. Side post insulator 60*a* can be made of HDPE, UHMW or polyurethane, although other nonconductive materials, or a combination of materials that are nonconductive, are also contemplated.

In the illustrated embodiment, side post insulator 60*a* can be shaped and positioned such that a portion of side post insulator 60*a* separates shoulder clamp 38 from the edge of top deck 14*a*, and separates steel clip 36 from mounting surface 22 of top deck 14*a*. In this manner, side post insulators 60*a, b* can facilitate the electrical insulation of rail 28*a* from rail 28*b*. Utilization of side plates 58*a, b*, side post insulators 60*a, b* and deck spacer 54 may provide substantial electric insulation of rail 28*a* from rail 28*b*. As will be appreciated by those skilled in the art in view of the disclosure provided herein, a variety of types and configurations of side post insulators and side plates and/or deck spacers can be utilized without departing from the scope and spirit of the present invention. For example, deck spacer 54, side plates 58*a, b*, and/or side post insulators 60*a, b* may comprise non-resilient materials, a side post insulator may be shaped and positioned in such a way that separates shoulder clamp 38 from mounting surface 16 of base deck 12, or a deck spacer may act as both deck spacer and side plate.

As shown in FIG. 3, stacked railway tie 10 may further include ramps 62 to create the proper angle and deflection of clip 36. A variety of types and configurations of ramps 62 can be utilized in order to create the proper angle and deflection of the clip 36 on the fastener 32. Ramps 62 may be configured to support the load on fastener 36 and side post insulator 60*a, b*. Ramps 62 can include steel and can be secured to mounting surface 22 of top deck 14 by welding.

As will be appreciated by one having ordinary skill in the art in view of the disclosure provided herein, ramps 62 may also be formed of a variety of conductive or nonconductive materials that can support the load on the fastener 36 and side post insulators 60*a, b*, including HDPE, metals, or composite materials. Other methods of securing the ramp to top deck 14 may also be used including rivets, brackets and screws, or friction. Side post insulators 60*a, b* can be placed on ramp 62 and secured by friction created by clip 36. However, one of ordinary skill in the art in view of the disclosure provided herein may also appreciate that ramp 62 may also be secured to side post insulators 60*a, b* by other suitable methods.

In the illustrated embodiment, rails 28*a, b* can be coupled to top decks 14*a, b* rather than to a single top deck 14. As will be appreciated by one of ordinary skill in the art in view of the disclosure provided herein, varying numbers of top decks 14*a, b* may be used in appropriate conditions. In one embodiment, top deck 14*a* can be substantially the same height as top deck 14*b*. However, multiple top decks 14*a, b* can enable the ability to independently vary the height of rails 28*a, b* with respect to base deck 12. Deck spacers 54 may vary the height of stacked railway tie 10 by creating a separation between top decks 14*a, b* and base deck 12. Where multiple deck spacers 54 are used, top deck 14*a* may be raised to a different height than top deck 14*b*. This can be advantageous in various circumstances, including where only one of rails 28*a, b* is out of alignment, or where rails 28*a, b* are both out of alignment but to differing extents.

An additional feature of stacked railway tie 10 with separate top decks 14*a, b* can be a reduced deadweight. In the illustrated embodiment, there can be a longitudinal separation between top decks 14*a, b*. Longitudinal separation between top decks 14*a, b* can result in decreased deadweight as compared to a stacked railway tie 10 of equal length but with a single top deck 14, such as that depicted in FIG. 1*a*. While increased deadweight can be advantageous in that it can improve vertical pullout, decreased deadweight may also be desirable in certain applications. For example, a decrease in the deadweight reduces the overall dead load that must be supported by bridges or railway foundations, and thus the costs of such structures.

Figure 4:
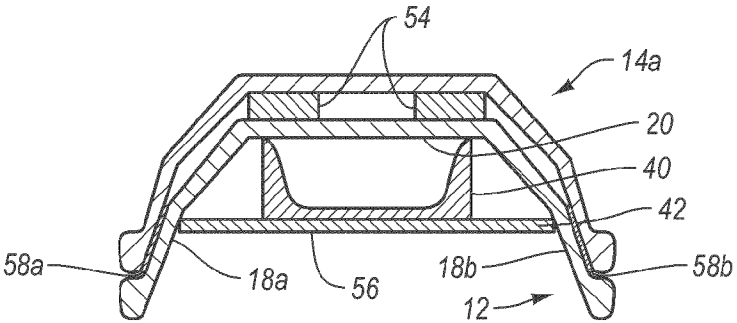
FIG. 4 is a cross-sectional view of the stacked railway tie of FIG. 3 illustrating a deck spacer, side plates, and a ballast displacement system.

FIG. 4 is a cross-sectional view of the stacked railway tie 10 of FIG. 3, illustrating top deck 14*a* stacked on base deck 12. In the illustrated embodiment, side plates 58*a, b* and deck spacer 54 can be utilized in order to electrically insulate top deck 14*a* from base deck 12, and ballast displacement system 56 can be used to distribute the load on base deck 12 to ballast. Deck spacer 54 includes two blocks spaced laterally apart so as to create support for top deck 14*a* in relation to base deck 12. Additionally, side plates 58*a, b* may be configured to reduce lateral movement between top deck 14*a* and base deck 12. In one embodiment, side plates 58*a, b* can be positioned between the sides of top deck 14*a* and the sides of base deck 12. Side plates 58*a, b* may be placed in communication with the sides of both top deck 14*a* and base deck 12, thereby removing or reducing any gaps that may exist between the sides of base deck 12 and top deck 14*a*. The use of side plates 58*a, b* in this manner can reduce the lateral movement between top deck 14*a* and base deck 12 and thus increase the stability of stacked railway tie 10.

In addition, the illustrated embodiment demonstrates an alternative embodiment of ballast displacement system 56. Ballast displacement system 56 may include a substantially flat plate 42 and a U-shaped channel 40. In one embodiment, channel 40 can be in contact and positioned against underside 20 of base deck 12, and plate 42 can be positioned on the bottom side of channel 40. Further, plate 42 may also be in contact with and/or coupled to the inside surface of sides 18*a, b* of base deck 12. Plate 42 may be coupled to base deck 12 and channel 40 via welding, rivets, brackets and screws, or by some other fastening means. It should be a appreciated by one of ordinary skill in the art in view of the disclosure provided herein that channel 40 may be of a variety of cross-sectional shapes and configurations, and may be, for example, hollow, solid, rectangle, trapezoid, or an I-beam. Alternatively, either channel 40 or plate 42 may be eliminated, or plate 42 and channel 40 may be integrally formed. Additionally, it should be appreciated that plate 42 does not need to be substantially flat, and may be, for example, arched, crimped, or bent.

Figure 5:
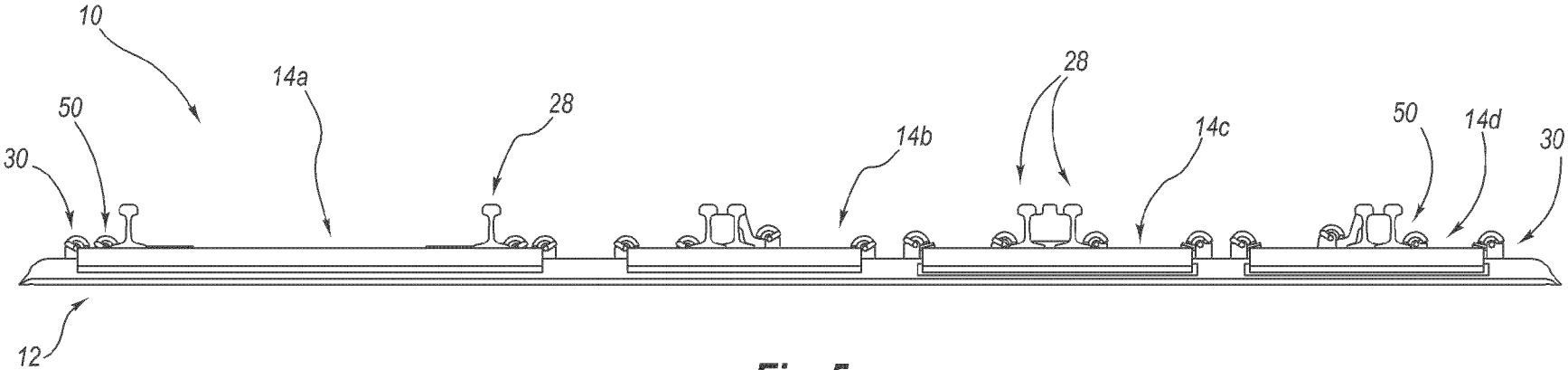
FIG. 5 is a frontal view of a stacked railway tie illustrating multiple tracks coupled to the base deck.

FIG. 5 is a frontal view of a stacked railway tie according to one embodiment of the invention. FIG. 5 illustrates the versatility of the present invention. For example the stacked tie system of the present invention can be utilized for use with a single track or multiple tracks as desired. As will be appreciated by one of skill in the art in view of the disclosure provided herein, a variety and types of configurations of stacked decks and tracks can be utilized without departing from the scope and spirit of the present invention. In addition, electrical insulation can be achieved where needed as described herein.

Figure 6:
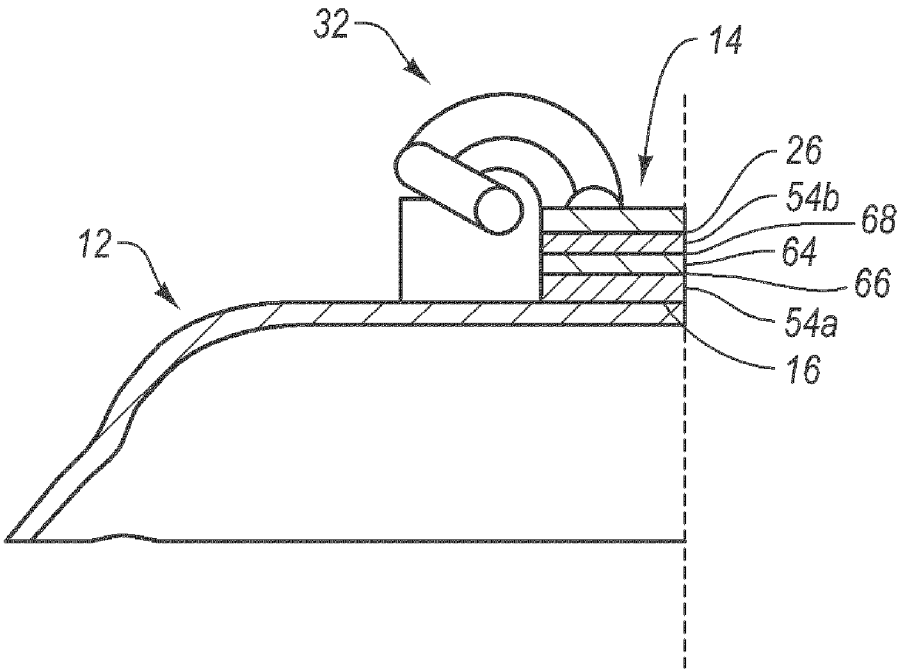
FIG. 6 is a cross-sectional view of a stacked railway tie illustrating a mid-deck between a top deck and base deck, and a clamp fastening the top deck to the base deck.

FIG. 6 illustrates one embodiment of the present invention wherein stacked railway tie 10 includes base deck 12, top deck 14 and a mid-deck 64 positioned between top deck 14 and base deck 12. In the illustrated embodiment, deck spacer 54*a* can be positioned between mounting surface 16 of base deck 12, and underside 66 of mid-deck 64 and deck spacer 54*b* can be positioned between mounting surface 68 of mid-deck 64 and underside 26 of top deck 14. Embodiments utilizing mid-deck 64 can feature an increased gap of separation between base deck 12 and top deck 14, yet still maintain the ability to transmit loads to base deck 12, while also allowing base deck 12 to remain deep into ballast so as to reduce ballast migration.

Figure 7:
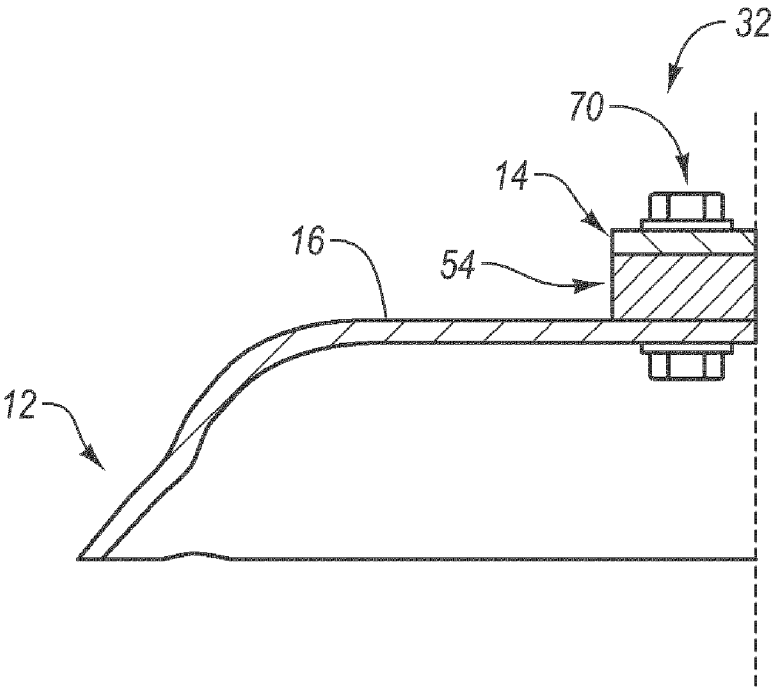
FIG. 7 is a cross-sectional view of a stacked railway tie illustrating a bolt fastener.

FIG. 7 illustrates an alternative embodiment of fastener 32*a, b*. In one embodiment, top deck 14 can be coupled to base deck 12 by bolt 70. Bolt 70 may provide a quick and efficient means whereby top deck 14 is coupled to base deck 12. Furthermore, bolt 70 may facilitate a quick and efficient replacement of top deck 14 and/or deck spacer 54 due to the ease of uncoupling and recoupling bolt 70.

It will be appreciated by one of ordinary skill in the art in view of the disclosure provided herein that the invention can be utilized in various railway configurations. For example, the invention can be utilized in connection with standard railway tracks, or alternatively with switches or turnouts, crossovers, diamonds or other configurations. Furthermore, the present invention can be configured to accommodate other trackwork material such as a frog, guard rail or switch point.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A stacked railway tie comprising:

a first deck;

a second deck coupled to the first deck, wherein the second deck is adapted to receive at least a portion of the first deck therein such that the first deck is at least partially nested within the second deck, and wherein the second deck is configured to facilitate coupling of a rail to the first deck;

a fastening system configured to couple the second deck to the first deck; and wherein the second deck has a concave lower surface defining a void in the second deck, and wherein the first deck has a convex upper surface, wherein the convex upper surface of the first deck is at least partially disposed within the void in the second deck when the second deck is coupled to the first deck.

2. A railway tie as recited in claim 1, wherein the first deck is configured to have the second deck stacked thereon, and wherein the second deck is configured to distribute a load to the first deck.

3. A railway tie as recited in claim 1, further comprising at least one spacer positioned substantially between the first deck and the second deck.

4. The railway tie as recited in claim 3, wherein the at least one spacer is nonconductive.

5. A railway tie as recited in claim 3, further comprising a mid-deck positioned between at least one of: (i) the first deck and the spacer; or (ii) the second deck and the spacer.

6. A railway tie as recited in claim 1, further comprising a ballast displacement system coupled to the first deck and configured to facilitate distribution of a load from the first deck to ballast.

7. A railway tie as recited in claim 1, wherein the fastening system is configured to reduce at least one of: (i) vertical movement of the second deck; (ii) lateral movement of the second deck; or (iii) longitudinal movement of the second deck.

8. A railway tie as recited in claim 1, wherein the fastening system releasably couples the second deck to the first deck such that the second deck can be selectively coupled to or removed from the first deck when a bottom surface of the first deck is positioned within ballast.

9. A stacked railway tie comprising:

a base deck having a convex primary surface;

a top deck positioned above the base deck, the top deck having a concave primary surface defining a void in the top deck, wherein the top deck is adapted to receive the convex primary surface of the base deck within the void such that the base deck is at least partially nested within the top deck, and wherein the top deck is configured to facilitate distribution of a load from the top deck to the base deck; and a first fastening system configured to couple the top deck to the base deck.

10. A railway tie as recited in claim 9, further comprising a second fastening system configured to couple a rail to the top deck.

11. A railway tie as recited in claim 9, further comprising a spacer positioned between the convex primary surface of the base deck and the concave primary surface of the top deck, the at least one spacer being adapted to transfer the load of the top deck to the base deck.

12. A railway tie as recited in claim 11, further comprising a mid-deck positioned between at least one of: (i) the base deck and the spacer; or (ii) the top deck and the spacer.

13. A railway tie as recited in claim 11, wherein the base deck is electrically insulated from the top deck.

14. A railway tie as recited in claim 13, wherein the spacer electrically insulates the base deck from the top deck.

15. A railway tie as recited in claim 14, further comprising one or more side plates positioned between the base deck and the top deck, wherein the side plates and the spacer electrically insulate the base deck from the top deck.

16. A height adjustable railway tie for reducing ballast migration in areas where the crib is reduced or removed in order to accommodate additional railway equipment, the railway tie comprising:

a base deck having a convex upper surface;

a first top deck coupled to the base deck, wherein the first top deck has a concave lower surface defining a void and is coupled to the base deck such that the convex upper surface of the base deck is nested at least partially within the void of the first top deck, the first top deck being configured to have a first rail linked thereto;

a second top deck nested over and coupled to the base deck, the second top deck being configured to have a second rail linked thereto; and at least one spacer positioned between the base deck and the first and second top decks, such that the at least one spacer offsets the first and second top decks from the base deck, wherein the at least one spacer is adapted to individually adjust the offset between (i) the first top deck and the base deck, and (ii) the second top deck and the base deck.

17. A height adjustable railway tie as recited in claim 16, further comprising a first fastening system adapted to couple the base deck to the first and second top decks.

18. A height adjustable railway tie as recited in claim 17, wherein the first fastening system comprises at least one clamp.

19. A height adjustable railway tie as recited in claim 16, further comprising a second fastening system adapted to couple the first and second rails to the first and second top decks, respectively.

20. A height adjustable railway tie as recited in claim 16, further comprising a mid-deck configured to increase separation between the top deck and the base deck, and positioned between at least one of: (i) the first deck and the spacer; or (ii) the second deck and the spacer.

21. A height adjustable railway tie as recited in claim 16, wherein the top deck and the at least one spacer are configured to facilitate distribution of a load between the top deck and the base deck.

22. A stacked railway tie comprising:

a substantially rigid base deck having a convex upper surface, a ballast displacement system secured to the underside of the base deck, wherein the ballast displacement system is configured to facilitate distribution of a load on the base deck to ballast positioned beneath the base deck; and a top deck including a concave lower surface defining a void, the top deck coupled to the base deck in such a manner that the convex upper surface of the substantially rigid base deck is at least partially disposed within the void in the top deck, wherein the top deck is configured to facilitate coupling of a rail to the base deck.

23. A stacked railway tie as recited in claim 22, wherein the ballast displacement system comprises at least one material selected from a group comprising: (i) steel; and (ii) HDPE.

24. A stacked railway tie as recited in claim 22, wherein the ballast displacement system comprises a plurality of portions.

25. A stacked railway tie as recited in claim 22, further comprising height adjustment means for selectively adjusting the vertical position of the top deck relative to the base deck.

26. A stacked railway tie as recited in claim 25, wherein the height adjustment means comprises at spacer.

27. A method for making a stacked railway tie comprising the steps of:

providing a base deck having a convex upper surface;

placing at least one spacer on the base deck;

stacking a top deck on the base deck, such that the spacer is positioned between the base deck and the top deck, wherein the top deck has a concave lower surface defining a void, and wherein stacking the top deck on the base deck causes the upper surface of the base deck to be least partially nested within the void of the top deck;

coupling the top deck to the base deck; and coupling a rail to the top deck, such that the rail is coupled to the base deck.

28. A method for making a stacked railway tie as recited in claim 27, wherein the step of coupling the top deck to the base deck further comprises clamping the top deck to the base deck.

29. A method for making a stacked railway tie as recited in claim 27, wherein the step of coupling the top deck to the base deck further comprises the step of bolting the top deck to the base deck.

30. A method for making a stacked railway tie as recited in claim 27, further comprising the steps of providing a second top deck and stacking the second top deck on the base deck such that the base deck is at least partially nested within the second top deck and the at least one spacer is positioned between the base deck and the second top deck.

31. A method for making a stacked railway tie as recited in claim 30, further comprising the step of electrically insulating the top deck from the second top deck.

32. A method for distributing a load between a stacked railway tie and ballast, comprising the steps of:

providing a base deck that is configured to receive a top deck thereon, the base deck including a convex upper surface and the top deck including a concave lower surface that defines a void;

configuring the base deck to receive a top deck;

coupling the top deck to the base deck such that the convex upper surface of the base deck is positioned at least partially within the void of the top deck;

configuring the top deck to distribute a load to the base deck; and placing a ballast displacement system in communication with the base deck, wherein the ballast displacement system is adapted to distribute the load on the base deck to ballast.

33. A method for distributing a load as recited in claim 32, wherein the step of configuring the top deck to distribute a load to the base deck comprises positioning a spacer at least partially between the base deck and the top deck.

34. A method for distributing a load as recited in claim 32, further comprising the step of electrically insulating the top deck from the base deck.

* * * * *